United States Patent [19]

Piston

[11] 4,213,018

[45] Jul. 15, 1980

[54] EXPLOSION-PROOF CONTACT ASSEMBLY AND METHOD OF FORMING THE SAME

[75] Inventor: Thomas P. Piston, Baldwinsville, N.Y.

[73] Assignee: Crouse-Hinds Company, Syracuse, N.Y.

[21] Appl. No.: 913,220

[22] Filed: Jun. 6, 1978

[51] Int. Cl.[2] ..... H01R 33/30; H01R 33/54

[52] U.S. Cl. ..... 200/51.12; 200/293; 174/50; 339/111; 339/218 M

[58] Field of Search ..... 339/111, 154 A, 156 R, 339/218 R, 218 M, 176 M, 4, 19; 200/51.09, 51.12, 293; 174/50

[56] References Cited

U.S. PATENT DOCUMENTS

| | | | |
|---|---|---|---|
| 3,235,682 | 2/1966 | Papworth | 200/51.09 |
| 3,281,560 | 10/1966 | Nava | 339/111 |
| 3,394,338 | 7/1968 | Hickes et al. | 339/111 |
| 3,723,724 | 3/1973 | Appleton | 200/51.09 |
| 3,860,315 | 1/1975 | Tetreault et al. | 339/111 |

*Primary Examiner*—Houston S. Bell, Jr.

*Attorney, Agent, or Firm*—Lackenbach, Lilling & Siegel

[57] ABSTRACT

A method of making an explosion proof contact assembly and the resulting contact assembly are described wherein the electrical contacts are first rigidly mounted on a contact unit or subassembly prior to the molding operation. This approach allows complete assembly of the contacts prior to molding of the contact unit within the insulating body, while maintaining required flame path for explosion proof atmospheres. The present invention eliminates post-molding assembly operations which are extremely difficult and substantially raise the cost of producing the contact assemblies.

7 Claims, 6 Drawing Figures

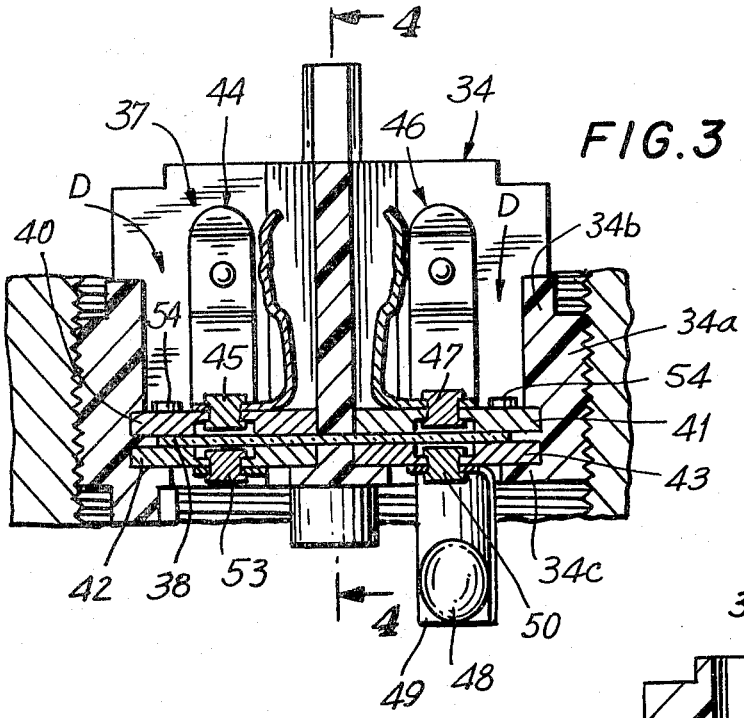
FIG. 3
FIG. 4
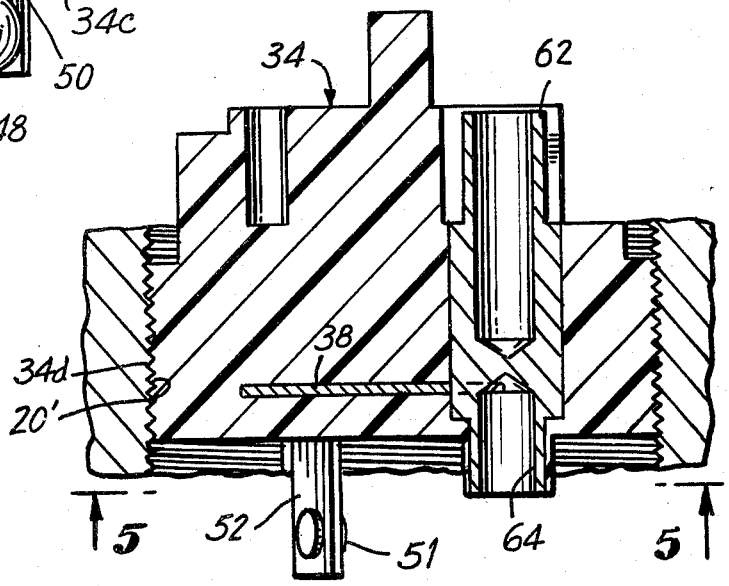
FIG. 5
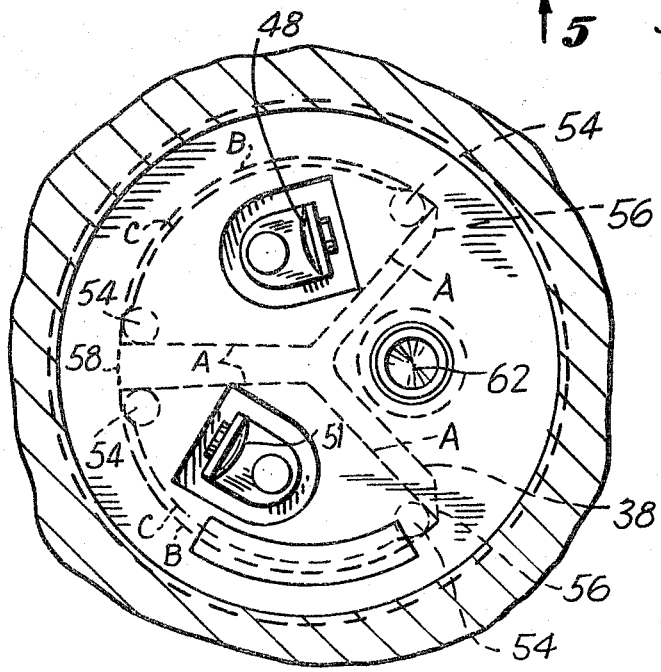
FIG. 6
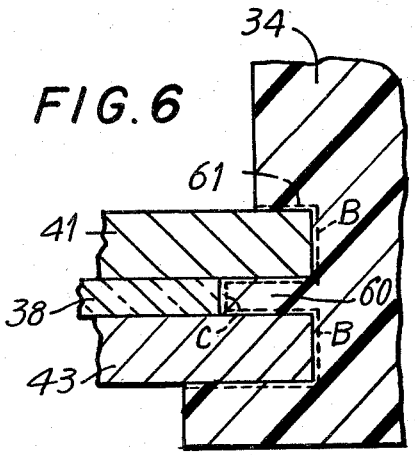

EXPLOSION-PROOF CONTACT ASSEMBLY AND METHOD OF FORMING THE SAME

BACKGROUND OF THE INVENTION

This invention generally relates to electrical contact assemblies, and, more specifically, to an improved explosion proof contact assembly and method of forming the same.

Contact assemblies are frequently used in hazardous locations in which quantities of flammable vapors, gases or the like exist in the surrounding atmosphere to create potentially explosive mixtures. It is, accordingly, extremely important in such hazardous locations to use explosion proof electrical devices which assure that any sparks created at electrical contacts are prevented from entering the potentially explosive atmosphere.

Electrical devices which are intended to be used in hazardous locations must, accordingly, be approved for the intended use.

An important factor in determining suitable uses of an electrical device in hazardous locations is the flame path. The flame path is normally considered to be the joint between two surfaces through which gases can travel from an area where an explosion can occur to where there can be combustible gases. It is desirable, therefore, to maintain the flame path at an adequate value to assure that sparks or hot gases become sufficiently cooled off as they travel along the flame path so as to become incapable of igniting explosive mixtures at the other end of the flame path.

The explosion proof flame path in existing receptacles is generally created by molding into the assembly separate metallic inserts for each contact. These inserts must be of sufficient length or contain sufficient grooves, ridges or other irregularities along the outside length to provide the required flame path. The inserts must be either solid or blind drilled and tapped. After the inserts are molded into the insulating body, the front and rear electrical contacts, which mate with the plug and line contacts, must then be assembled by either staking or fastening the contacts to the metallic inserts with screws. One example of an electrical device which utilizes long electrical conductors to provide the required flame path is the BHR insulator manufactured by the Crouse-Hinds Company.

The Crouse-Hinds Company has also made a contact assembly designated the ENR receptacle which was constructed so that the flame path requirements were met by having sufficient length of joint, from the front to rear, between the outside surface of the brass contact inserts and the surrounding molded plastic. After the insulator was molded, with the inserts molded in, the front, three-pronged contact and the rear, right-angled copper strap and button were then assembled to the contact inserts by placing them in the proper position and fastening them in place by staking over the ends of the contact inserts. The staking operation for the front, three-pronged contact required the staking tool to slide between the two parallel prongs of the contact in order to accomplish the staking. The tool, if not perfectly centered on the contact, could hit one of the prongs and push it down almost flat. Even when centered, there was no consistency where the tool would strike the insert. When the insert was staked off-center, a weak, unacceptable joint resulted. Both of the conditions mentioned resulted in complete loss of the insulator. The molded part could not be salvaged. In the situation where the tool was centered and the staking tool produced a good joint between the contact and the insert, the blade of the staking tool usually spread the two parallel prongs of the contact apart, necessitating manual rework to bend them back into position. The post-molding assembly operations used in the manufacture of the ENR receptacle were extremely difficult and expensive.

Other prior art constructions of electrical devices for use in hazardous locations are disclosed in the following U.S. Pat. Nos. 3,235,682; 3,281,560; 3,394,338; 3,723,724 and 3,860,315. In U.S. Pat. No. 3,235,682, a connector is described where the flame path is formed by the contact/insulator interface which is designed to conventional standards of flame path lengths for axial joints. The rear insulator also must be potted after the molding process to insure contact spacings. The connector construction disclosed in Pat. No. 3,281,560 is not a complete molded assembly, but rather a sandwich construction with a resilient disc which is compressed by rigid thermoset plastic discs on either side. Explosion proof integrity is obtained primarily by inducing vaporization of a sublimable solid to generate flame extinguishing gases within the arcing chamber. The explosion proof electrical connector disclosed in U.S. Pat. No. 3,394,338 is designed for low energy, less than 500 watts, applications. The flame path is formed by a sandwich of three plastic discs and is only of the order of one-sixteenth of an inch in length with a clearance on the order of five-thousandths of an inch. The flame path configuration does not follow established standards for explosion proof flame paths. U.S. Pat. No. 3,723,724 discloses a safety mounted explosion proof light fixture. When the lamp section is removed from the mounted section, the contacts break at a point where the enclosure formed by the housing and the threaded joint with the lamp section still has explosion proof integrity due to a minimum of five threads still engaged. The explosion proof connector which forms the subject matter of U.S. Pat. No. 3,860,315 has conventional flame paths through the joints of the insulating members and incorporates a telescoping housing to form the arcing chamber and depends upon threaded joints of the telescoping housing for cooling of gases escaping to the atmosphere.

Generally, the electrical devices disclosed in the above-identified patents are complex in construction and, therefore, expensive to manufacture. In some instances, the devices are impractical or ineffective for the purposes intended.

SUMMARY OF THE INVENTION

Accordingly, it is an object of the present invention to provide an explosion proof contact assembly which does not possess the disadvantages associated with comparable prior art explosion proof contact assemblies.

It is another object of the present invention to provide an explosion proof contact assembly which is simple in construction and economical to manufacture.

It is still another object of the present invention to provide an explosion proof contact assembly which eliminates post-molding assembly operations.

It is yet another object of the present invention to provide an explosion proof contact assembly which materially decreases the amount of scrap or parts resulting from damage during post-molding assembly operations.

It is a further object of the present invention to provide an explosion proof contact assembly which eliminates post-molding assembly operations while still maintaining the flame path requirements for hazardous locations established by Underwriters Laboratories' Standard 1010.

It is yet a further object of the present invention to provide a method of forming an explosion-proof contact assembly of the type suggested in the above objects.

In order to achieve the above objects, as well as others which will become apparent hereafter, an explosion proof contact assembly in accordance with the present invention comprises a base member and a plurality of electrical contacts arranged in pairs with the two contacts of each pair being disposed on opposite sides of said base member and being in electrical continuity with each other. Said electrical contacts and base member together form a substantially rigid contact unit. A contact body is provided suitable for mounting in a contact assembly which receives said contact unit. Said contact body covers and sealingly contacts substantial portions of said base member while exposing said electrical contacts and providing the required flame path between the resulting compartments on the two opposite sides of said base member when said contact unit is received within said contact body.

The method of forming an explosion proof contact assembly in accordance with the present invention comprises the steps of mounting a plurality of electrical contacts on a base member. The electrical contacts are arranged in pairs with the two contacts of each pair being disposed on opposite sides of said base member and being in electrical continuity with each other. Said electrical contacts and base member together form a substantially rigid contact unit. Said contact unit is subsequently molded within a contact body suitable for mounting in a contact assembly, substantial portions of said base member being sealingly covered in the molding operation while exposing said electrical contacts and providing the required flame path between the compartments resulting on the two opposite sides of said base member.

BRIEF DESCRIPTION OF THE DRAWINGS

Further advantages of the invention will become apparent from a reading of the following specification describing an illustrative embodiment of the invention. The specification is to be taken with the accompanying drawings in which:

FIG. 3 is a cross-sectional view of the contact assembly shown in FIG. 2 taken along line 3—3, showing the details of the contact unit which is received within the molded top contact body;

FIG. 4 is a cross-sectional view of the top contact body shown in FIG. 3 taken along the line 4—4;

FIG. 5 is a bottom plan view of the top contact body shown in FIG. 4 as viewed along arrows 5—5; and FIG. 6 is an enlarged section of the contact unit shown in FIG. 3, showing the manner in which the flame path is increased along certain portions of the periphery of the contact unit.

DETAILED DESCRIPTION OF A PREFERRED EMBODIMENT

The contact assembly of the present invention is designed for use in the following categories established in the National Electrical Code: Class I, Groups B, C and D; Class II, Group G; and Class III. The contact assembly of the present invention maintains the flame path requirements for hazardous locations for receptacles established by Underwriters Laboratories' Standard 1010.

Figure 1:
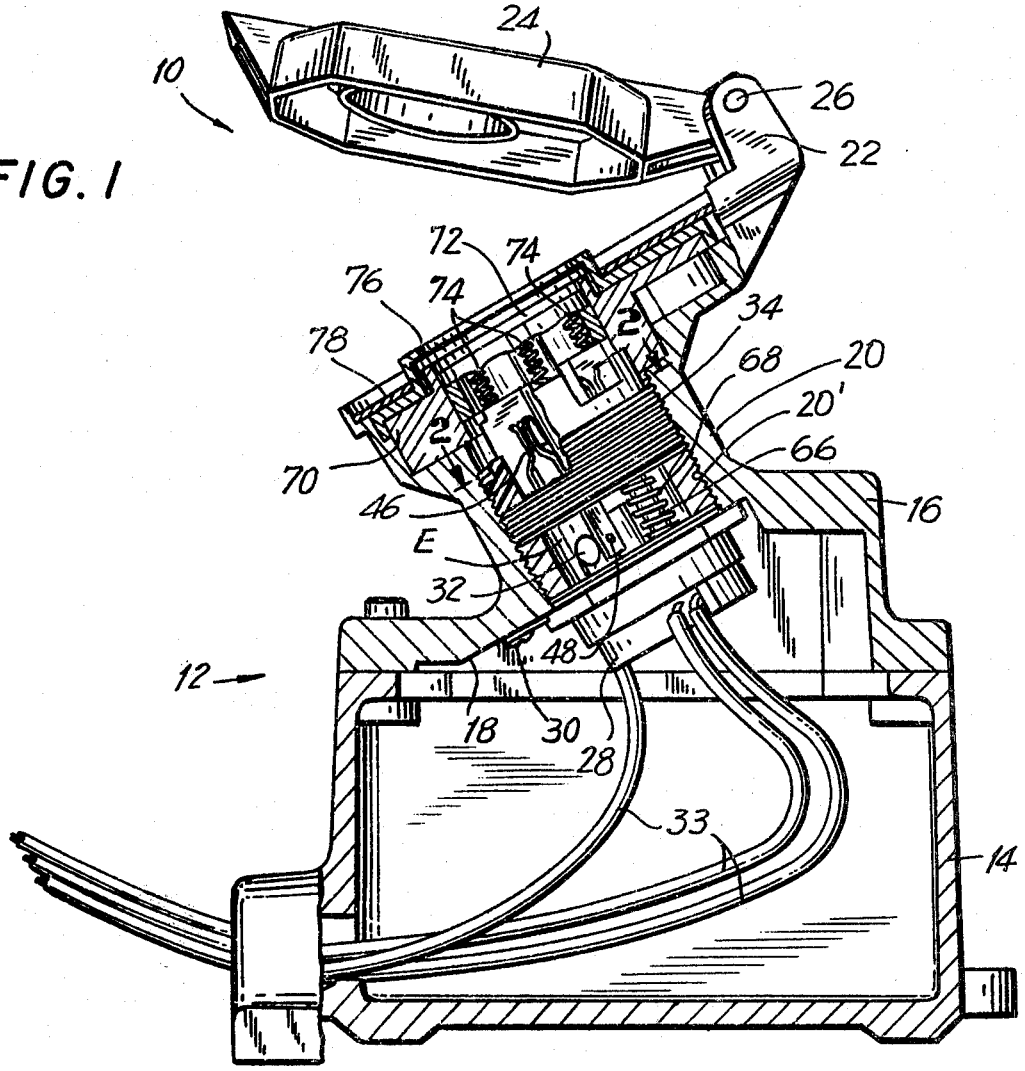
FIG. 1 is a side elevational view of a contact assembly in accordance with the present invention, shown partly in cross-section.

Referring now more specifically to the drawings, in which identical or similar parts are designated by the same reference numeral throughout, and first referring to FIG. 1, the contact assembly in accordance with the present invention is generally designated by the reference numeral 10.

The contact assembly 10 includes a housing 12 made up of a junction box 14 and a contact support member 16 connected to each other by any conventional means. The contact support member 16 is provided with an inclined surface 18 and an outwardly projecting neck portion 20 having a generally circular cross-section and an axis which is normal to the inclined surface 18.

At the outer or remote end of the neck 20 there are provided a pair of lugs or standoffs 22 on which a spring cover or door 24 is rotatably mounted by means of a pin 26.

A contact body 28 is mounted in abutment against the inclined surface 18 by means of, for example, screws 30. The contact body 28 supports fixed contacts 32 as well as the ground contact (not shown) which are connected to the leads or conductors 33.

The neck 20 is generally cylindrical in shape and is provided with internal threads 20' which are adapted to threadedly engage the external threads of a top contact body 34 which incorporates the present invention.

Referring to FIGS. 2–6, the top contact body 34 includes a contact separator plate 38 made of an electrically insulating material and may be in the nature of a fiberglass reinforced plastic disc. As best shown in FIG. 5, the separator plate 38 includes a substantially circular portion having a predetermined or nominal diameter, with a sector of the separator plate being removed to accommodate a ground contact as will be described below.

A pair of contact base plates 40,41 are disposed on one side of the contact separator plate 38, and two contact base plates 42,43 are disposed on the other side thereof.

The contact base plates 40–43 are made of an electrically conducted material such as brass.

A plurality of electrical contacts are arranged in pairs with two contacts of each pair being disposed on opposite sides of the contact separator plate 38. A three-pronged contact 44 is fixedly connected to the base plate 40 in electrically conductive abutment by means of a rivet 45. Similarly, the three-pronged contact 46 is rigidly supported in electrically conductive abutment against the base plate 41 by means of the rivet 47. The electrical contact button 48, mounted on the contact bracket 49, is secured to the base plate 43 by means of the rivet 50. The contact button 51 mounted on the contact bracket 52 (FIG. 4) is connected to the base plate 42 by means of rivet 53. The surfaces of the base plates 40–43 facing the contact separator plate 38 are advantageously provided with recesses adapted to accommodate the heads of the respective rivets as shown in FIG. 3.

The three-pronged contact 44 and the button contact 51 form one pair of associated contacts, as do the contacts 46 and 48. Rivets 54 extend through each associated pair of base plates and the contact separator plate to fixedly secure these members to each other as well as to provide electrical continuity between the associated base plates on opposite sides of the contact separator plate and, therefore, electrical continuity between the associated electrical contacts. The contact separator plate 38 and the contact base plates 40–43 together form a base member on which the electrical contacts are mounted. The base member together with the electrical contacts mounted thereon together form a substantially rigid contact unit which is assembled prior to the molding operation. In this manner, if some part of the contact unit should be deformed or not assembled properly, the remainder of the assembly can be salvaged for reassembly. It is only when the contact unit is properly assembled that it is molded within the top contact body 34.

Figure 2:
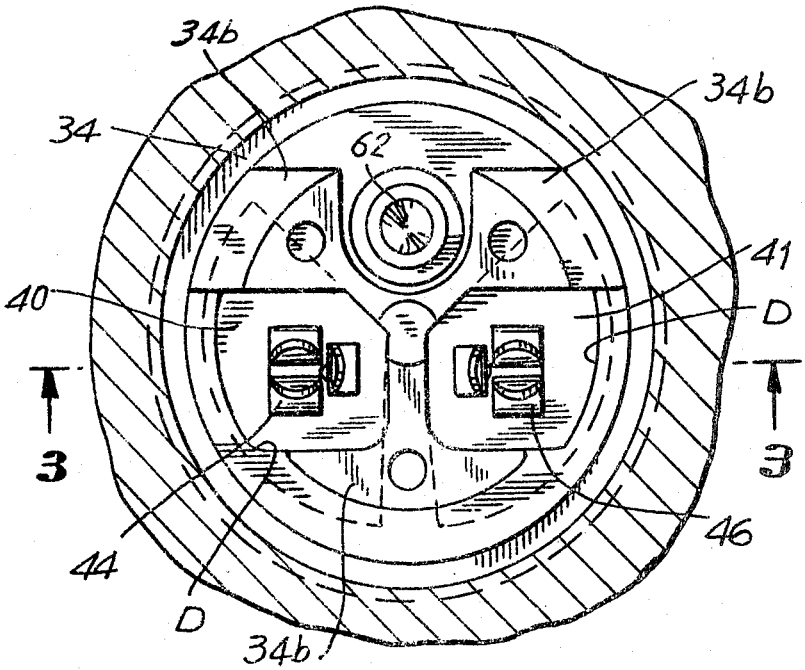
FIG. 2 is an enlarged cross-sectional view of a portion of the contact assembly shown in FIG. 1 taken along line 2—2.

As can best be seen in FIGS. 2 and 5, each pair of associated base plates are similarly shaped and are coextensively arranged on opposite sides of the separator plate. Thus, the base plates 40 and 42 are similarly shaped and coextensive with each other, as are the base plates 41 and 43 to each other. While the specific shape of the contact separator plate and the base plates is not critical for purposes of the present invention, the separator plate 38 in accordance with a presently preferred mode of the invention includes a substantially circular portion having a predetermined or nominal diameter, and the base plates 40–43 are sector-shaped each having two radially extending straight sides A (FIG. 5) and a generally curved side B extending between the outer ends of the straight sides A.

The electrical contacts are positioned generally centrally on associated base plates and are positioned more proximately to the curved sides B thereof than to the outer ends of the straight sides A of the base plates. The outer ends of the straight sides A of the base plates are coextensive with the outer edge or periphery of the contact separator plate, such as at 56 and 58. At these coextensive locations, the contact separator plate 38 and the base plates have substantially the same predetermined diameter or radius. However, the separator plate 38 is undercut and has a curved edge or periphery at C which has a diameter or radius less than the predetermined or nominal diameter in the regions proximate to the electrical contacts to form a recess or channel 60 (FIG. 6) between the curved sides B of the base plates to maintain a substantially constant or uniform flame path about the entire peripheries of the base plates.

Once the contact unit has been fully and properly assembled, the contact unit is molded within a contact body 34 suitable for mounting in a contact assembly 10. Substantial portions of the base member, which includes the contact separator plate 38 and the base plates 40—43, are sealingly covered in the molding operation. More particularly, the peripheral and curved edges of the base plates and contact separator plate are embedded within the top contact body 34, which may be made of fiberglas reinforced polyester. Referring to FIG. 6, the top contact body 34 is shown to fill the recess or channel 60 between the base plates so as to maintain the desired flame path 61.

Aside from the contact unit and the manner in which the unit is embedded within the top contact body 34, the top contact body is generally similar to the top contact body used in the ENR receptacle made by the Crouse-Hinds Company. Now, the contact body 34 is molded to cover portions of the base member on which the contacts are mounted, as noted, and includes chambers, compartments or cavities D which expose the three-pronged contacts 44 and 46 and makes these accessible. While the chambers or compartments D may be regarded as being exterior, the top contact body 34 together with the contact body 28 together form an interior chamber or compartment E (FIG. 1). The fixed contacts 32 mounted on the contact body 28, as well as the movable contacts 48 and 51 mounted on the top contact body 34 are housed within the interior chamber or compartment E. Also exposed in the interior chamber E, as noted above, is a contact surface (not shown) which is used in conjunction with the ground circuit. An elongate ground contact 62 is embedded in the top contact body 34, as best shown in FIG. 4, being provided with an elongate bore 64 adapted to slidingly receive a ground pin or contact 66 which is in contact with the ground contact 62 as well as with the contact surface on the contact body 28. A compression spring 68 is coaxially mounted exteriorly of the ground contact or pin 66 to assure reliable electrical continuity in the ground line.

The outer end of the neck portion 20 is shown in FIG. 1 to be provided with an annular member 70 which cooperates with a plug locking plate 72 which is in the nature of a floating disc. The locking plate 72 is resiliently mounted on springs 74 and can only rotate when depressed by a plug to a given position as a result of a system of grooves and ridges which are well known to those skilled in the art. Also shown is a neoprene rubber gasket 76 and a name plate 78, all of which are conventional.

The interfaces between the molded polyester material and the contact unit are of a cumulative length sufficient or great enough to form an explosion proof flame path. While meeting all of the required standards, however, the contact assembly in accordance with the present invention is much simpler to manufacture and, therefore, less costly. As noted, the important feature of the present invention is the preliminary assembly of the contact unit which includes the contact separator plate 38, the base plates 40–43 and the electrical contacts. Such preliminary assembly takes place prior to any molding operation and, therefore, outside of the top contact body 34. The base regions of the contacts, which are riveted to the base plates, are more accessible and assembly is facilitated. Equally importantly, however, is that if part of the contact unit is not properly assembled, the remainder of the contact unit can be salvaged for reassembly. This could not be done with the prior art approaches wherein the molding operation took place prior to attachment of the electrical contacts. Only when the contact unit is properly assembled is it molded in the top contact body, to thereby substantially increase the output and decrease the losses during manufacture.

It is to be understood that the foregoing description of the preferred embodiment illustrated herein is exemplary and various modifications of the embodiment shown may be made without departing from the spirit and scope of the invention.

What is claimed is:

1. An explosion proof contact assembly comprising a base member; a plurality of electrical contacts arranged in pairs with the two contacts of each pair being disposed on opposite sides of said base member; means for providing electrical continuity between the two contacts of each pair, said electrical contacts and base member together forming a substantially rigid contact unit; and a contact body suitable for mounting in a contact assembly which receives said contact unit to form two compartments for said contacts, said contact body covering and sealingly contacting the peripheral surfaces of said base member while exposing said electrical contacts in each compartment and forming a flame path which is defined as the path having the shortest distance between said compartments as measured along the areas of contact between said contact unit and said contact body.

2. A contact assembly as defined in claim 1, wherein said base member comprises a contact separator plate made of an electrically insulating material; and one electrically conductive base plate connected to each electrical contact, each base plate rigidly supporting in electrically conductive abutment an associated electrical contact and being rigidly mounted on said contact separator plate; and electrically conductive means for providing electrical continuity between the base plates associated with each pair of electrical contacts.

3. A contact assembly as defined in claim 2, wherein said electrically conductive means comprises rivets which also rigidly fix each pair of associated base plates to said contact separator plate and to each other.

4. A contact assembly as defined in claim 2, wherein each electrical contact is rigidly mounted on an associated base plate by means of a rivet.

5. A contact assembly as defined in claim 2, wherein each pair of associated base plates are similarly shaped and are coextensively arranged on opposite sides of said separator plate.

6. A contact assembly as defined in claim 2, wherein said separator plate includes a substantially circular portion having a predetermined diameter and said base plates are sector shaped each having two radially extending straight sides and a generally curved side extending between said outer ends and substantially coextensively with the periphery of said separator plate.

7. A contact assembly as defined in claim 6, wherein said electrical contacts are positioned generally centrally on associated base plates and are positioned more proximately to said curved sides than the outer ends of said straight sides of said base plates, the separator plate periphery being coextensive with the outer ends of said straight sides and having a diameter less than said predetermined diameter proximate to said curved sides to form recesses between said curved sides of said base plates to maintain the required flame path.

* * * * *